United States Patent [19]

Rohrbach

[11] Patent Number: 4,729,434

[45] Date of Patent: Mar. 8, 1988

[54] PORTABLE FIRE-FIGHTING APPARATUS

[76] Inventor: Jerry T. Rohrbach, 11014 English St., Hoagland, Ind. 46745

[21] Appl. No.: 856,275

[22] Filed: Apr. 28, 1986

[51] Int. Cl.[4] ..... A62C 27/28

[52] U.S. Cl. ..... 169/24; 169/9; 169/15; 239/113

[58] Field of Search ..... 169/11, 15, 9, 24, 52; 239/113, 172, 175, 305, 307

[56] References Cited

U.S. PATENT DOCUMENTS

| | | | |
|---|---|---|---|
| 1,829,714 | 10/1931 | McElroy et al. | 169/15 |
| 2,210,934 | 8/1940 | Gleason | 239/113 |
| 2,352,379 | 6/1944 | Geertz | 169/24 |
| 2,418,858 | 4/1947 | Urquhart | 169/15 X |
| 2,611,439 | 9/1952 | Faulkner | 169/15 |
| 3,724,554 | 4/1973 | Rupert et al. . | |
| 3,770,060 | 11/1973 | Forsyth et al. . | |
| 3,840,074 | 10/1974 | Clark . | |
| 4,037,664 | 7/1977 | Gibson . | |
| 4,291,769 | 9/1981 | Müller . | |
| 4,410,045 | 10/1983 | Whitman . | |
| 4,488,603 | 12/1984 | Schmittmann et al. . | |
| 4,512,412 | 4/1985 | Campbell | 169/24 |
| 4,593,855 | 6/1986 | Forsyth | 169/24 X |

FOREIGN PATENT DOCUMENTS

| | | | |
|---|---|---|---|
| 2335680 | 1/1975 | Fed. Rep. of Germany | 169/24 |
| 672769 | 5/1952 | United Kingdom | 169/9 |

OTHER PUBLICATIONS

Photograph of a fire-fighting apparatus (marked Exhibit I).

*Primary Examiner*—Joseph F. Peters, Jr.
*Assistant Examiner*—Paul E. Salmon
*Attorney, Agent, or Firm*—Barnes & Thornburg

[57] ABSTRACT

A portable fire fighting apparatus has a plurality of tanks containing a variety of fire fighting agents, a piping arrangement for selectively connecting the tanks to respective discharge nozzles, and a central control panel which is provided with a plurality of control valves and elements for selectively controlling the discharge of the fire extinguishing agents through the nozzles. In a preferred embodiment, the apparatus has three tanks containing water, a chemical fire extinguishing agent, and a foam concentrate, respectively. Water only or a water/foam concentrate mixture is controllably discharged through a first nozzle, while the chemical fire extinguishing agent may be separately or simultaneously discharged through a second nozzle. A piping arrangement for purging the nozzles following discharge is provided and is controllable from the central control panel. The apparatus may be adapted for mounting on a truck, a forklift, or other vehicle. The preferred capacity of the water tank is approximately 200 gallons, the preferred capacity of the chemical tank is approximately 500 pounds, and the preferred capacity of the foam concentrate tank is approximately 15 gallons.

10 Claims, 8 Drawing Figures

PORTABLE FIRE-FIGHTING APPARATUS

BACKGROUND AND SUMMARY OF THE INVENTION

This invention relates generally to fire-fighting apparatus and, more particularly, to portable fire-fighting apparatus having a multi-agent capability for suppressing fires of differing types.

Various types of fire-fighting apparatus are presently used in an array of municipal, industrial and military applications. However, the typical apparatus used by municipalities and others for fighting relatively large structural fires are relatively large units, such as pumpers or tank trucks, capable of applying large quantities of a fire extinguishing agent (usually water) to a fire. The initial and operating costs of such equipment continues to escalate, as does the incentive for many of the affected organizations and entities to reduce such costs.

Another recent development of concern is the relatively wide spread usage of an array of plastics and synthetics in an increasing number of structures and products. Many of these materials are Class "B" combustibles which are extremely difficult and dangerous to extinguish with water. Thus, there is a need for more usage of alternative fire extinguishing agents (such as dry powder or Halon) in fighting fires of all types and proportions.

Notwithstanding the need for fire departments to be adequately equipped to fight fires of substantial proportions, it has been determined that a large percentage of operational calls from fire stations result in the use of little or no water for extinguishing the fire, and that more than 90% of such calls result in the use of less than 200 gallons of water for fire extinguishing purposes. In spite of these statistics, the relatively large fire fighting units mentioned above are typically used for responding to emergency calls because of the need for having a substantial fire fighting capability on hand at the fire scene.

An object of the present invention is to provide a relatively inexpensive and cost-efficient fire fighting apparatus which provides a substantial capability for fighting relatively large structural and other types of fires.

Another object of the present invention is to provide a fire fighting apparatus which is capable of applying a variety of fire fighting agents to fires, as changing situations warrent.

Yet another object of the present invention is to provide a fire fighting apparatus of the aforementioned type which can be conveniently, safely and efficiently operated by a minimal number of fire fighting personnel.

These and other objects and advantages are attained in a portable fire fighting apparatus which includes a plurality of tanks containing a variety of fire extinguishing agents, a piping arrangement for selectively supplying the agents to respective discharge nozzles, and a centralized control panel or station which has a number of control elements for controlling operation of the apparatus in a safe, efficient, and convenient manner. A preferred embodiment of the apparatus of the present invention includes a frame, first, second and third tanks supported on the frame, a piping arrangement for selectively connecting the tanks to associated discharge nozzles, a source of pressure for pressurizing the tanks, and a central control panel which has a variety of control valves and elements for selectively controlling the discharge of the contents of the tanks through the nozzles. In this preferred embodiment, the first tank contains a quantity of water, the second tank contains a quantity of chemical fire extinguishing agent, and the third tank contains a foam concentrate. The first and third tanks are connected to a first discharge nozzle by control valves and a foam inductor allowing for the discharge of water or foam from the first discharge nozzle. The second tank preferably contains a quantity of a chemical fire extinguishing agent, such as dry powder or Halon. The control valves and other control elements associated with each of the tanks are located on the central control panel to provide for centralized control of the supply of water, foam concentrate and chemical fire extinguishing agent to the respective nozzles.

The preferred embodiment of the present invention further includes piping arrangements and control valves for purging the first and second nozzles and associated connecting elements following discharge of fire extinguishing agents. The control valves for controlling the purging operations are accessible from the central control panel, and are preferably connected to a source of purging fluid and to the respective nozzles by non-metallic, relatively flexible piping, such as pressure rated plastic tubing. In an especially preferred embodiment, the first and third tanks are connected to the first discharge nozzle by connecting elements which include a foam inductor which is serially connected between the first nozzle and the first and third tanks. The fluid carrying capacity of the foam inductor is sufficient for operation of the apparatus in water-only or water/foam concentrate mixture modes. The preferred capacity for the embodiment of the invention described below is approximately 60 gallons per minute.

In a preferred embodiment of the invention, the chemical fire extinguishing agent provided is Halon. In this embodiment, the apparatus is preferably provided with a piping arrangement for refilling the second tank with Halon under the control of control elements accessible from the central control panel. These control elements are preferably connected to the second tank by non-metallic, relatively flexible tubing.

The frame of the preferred embodiment of the present invention may be specifically adapted to allow the apparatus to be carried to a desired location by a forklift truck, and used at that location while supported by the forklift truck. Alternatively, the frame may be adapted to allow the apparatus to be mounted on a truck or other vehicle.

In a preferred embodiment using water, foam concentrate and a chemical fire extinguishing agent, the preferred capacity of the first (water) tank is approximately 200 gallons, the capacity of the second (chemical) tank is approximately 500 pounds, and the capacity of the third (foam concentrate) tank is approximately 15 gallons. These capacities provide a substantial fire fighting capacity in a highly cost efficient apparatus.

Further objects, features, and advantages of the present invention will become more apparent from the following description when taken with the accompany drawings which show, for purposes of illustration only, an embodiment in accordance with the present invention.

DETAILED DESCRIPTION OF THE DRAWINGS

Figure 1:
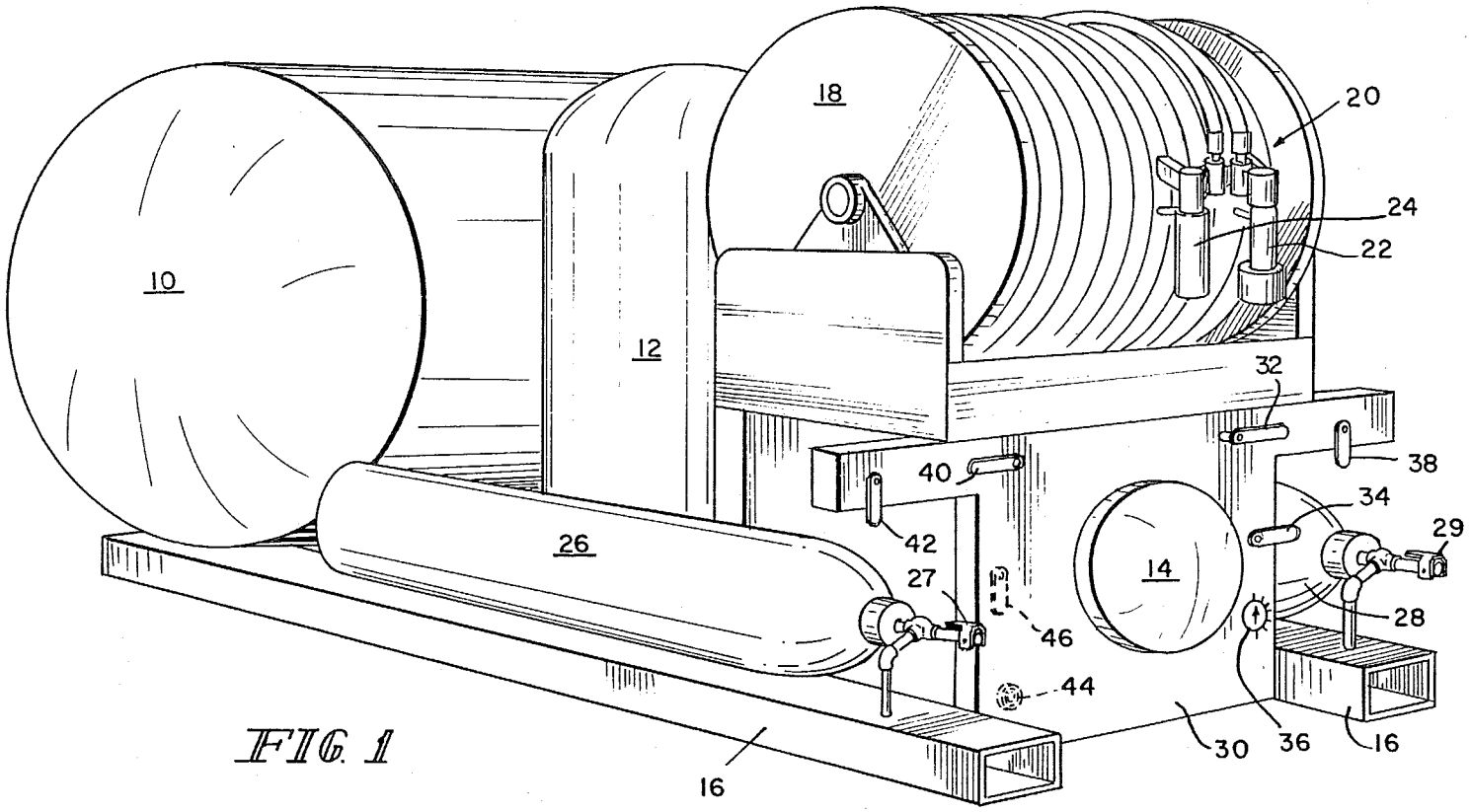
FIG. 1 shows a schematic representation of the fire fighting apparatus of the present invention.

FIG. 1 shows a schematic representation of a preferred embodiment of the portable fire fighting apparatus of the present invention. The apparatus of FIG. 1 includes a first tank 10, which in the preferred embodiment to be described contains water, a second tank 12, which preferably contains a chemical fire extinguishing agent such as Halon or dry powder, and a third tank 14, which in the preferred embodiment illustrated contains a foam concentrate (such as, AFFF or ATC). The preferred capacity of tank 10 is approximately 200 gallons when water is used as the fire extinguishing agent. The preferred capacity of tank 12 is approximately 500 pounds of chemical agent, and tank 14 preferably contains 15 gallons of foam concentrate. These quantaties are considered by the inventor to strike an optimal balance between providing a substantial fire fighting capacity on the one hand, while adequately addressing the matter of cost-effiency, in terms of initial and operating costs, on the other hand.

The tanks illustrated in FIG. 1 are preferably mounted on and supported by a frame 16, which is illustrated generally in FIG. 1 by two box beams. In the preferred embodiment, frame 16 is designed so as to allow the apparatus to be carried by an industrial type forklift truck. Alternatively, the frame can be adapted so as to allow the apparatus to be temporarily mounted in a truck or other vehicle. Although the apparatus can be more permanently mounted on a vehicle or other movable structure, such vehicle or structure is not considered to be required as an integral part of the inventive apparatus.

The apparatus of FIG. 1 further includes hose reel 18 which includes two separate lengths of hose which are connected to tanks 10, 12 and 14, as described in more detail below. At the discharge ends of the hoses is a dual nozzle 20, which includes a first discharge nozzle 22 for discharging water and water/foam concentrate mixtures and a second discharge nozzle 24 for discharging chemical fire extinguishing agents. Nozzles 22 and 24 are connected together as a single unit and include individual cut-off valves which can be manually operated at the nozzle by the operator. Such nozzles are commercially available from Task Force Tips, Inc. of Valparaiso, Indiana or Feecon Corp. of Westborough, Massachusetts.

The apparatus of FIG. 1 further includes a source of pressurized fluid which, in the preferred embodiment illustrated, includes a cylinder 26 of compressed nitrogen gas and a cylinder 28 of compressed nitrogen/air mixture (breathing air). Each cylinder is equipped with a shut-off valve (27 and 29), as shown. Although compressed nitrogen may be used in both cylinders to power the fire fighting apparatus of the present invention, compressed breathing air may optionally be used in connection with the water and foam concentrate tanks. Compressed nitrogen must, however, be used in connection with the chemical fire extinguishing tank. These cylinders are connected to the above-mentioned tanks to provide a source of pressure for discharging the tank contents. The manner of connection and operation of the respective systems will be discussed more completely with reference to FIGS. 2–4.

The remaining major element illustrated in FIG. 1 is a central control panel 30 which is supported by frame 16 and located near an end of the fire fighting apparatus. Mounted on control panel 30 are a plurality of valves, ports and controls which are conveniently located at this central location to allow for safe, efficient, and convenient control of the fire fighting apparatus. On the right side of control panel 30 (as viewed in FIG. 1) is water supply control 32, foam concentrate supply valve 34, foam proportioning valve 36, and water/foam concentrate purge valve 38. On the left side of control panel 30 are chemical fire extinguishing agent control 40 and chemical agent purge valve 42. In addition, when Halon is used as the chemical fire extinguishing agent, refill coupler 44 (which is preferably a snap-type coupling) and Halon tank vent valve 46, are provided on the left side. These elements are depicted in dashed lines in FIG. 1. In an especially preferred embodiment of the invention, the various control handles and valves located on central control panel 30 are color coded for operation in accordance with printed, color coded instruction sets provided to the operator. The interconnections between the various valves and controls on control panel 30 and the other components of the apparatus is fully discussed below and illustrated in FIGS. 2, 3 and 4, by reference to the individual sub-systems of which they are a part.

Figure 2A:
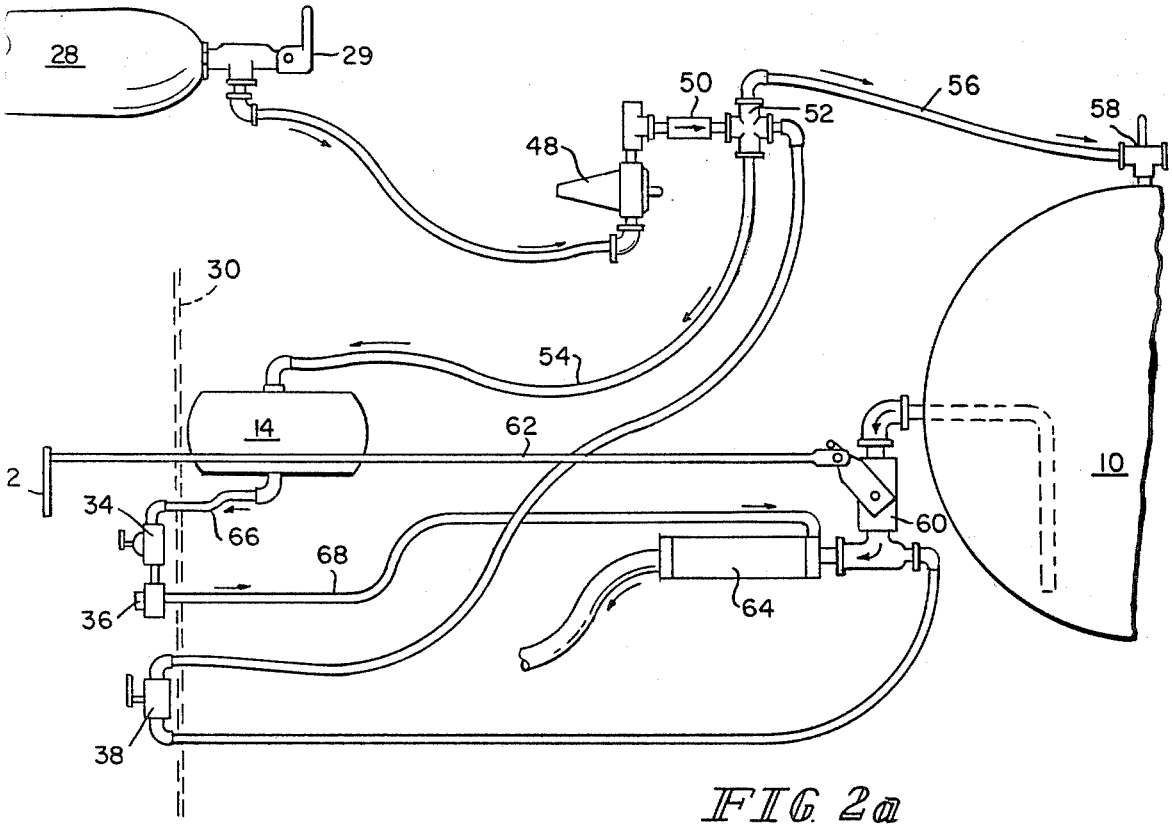
FIG. 2(*a*) and 2(*b*) show a preferred piping arrangement for the water and foam concentrate systems of a preferred embodiment of the present invention.
Figure 2B:
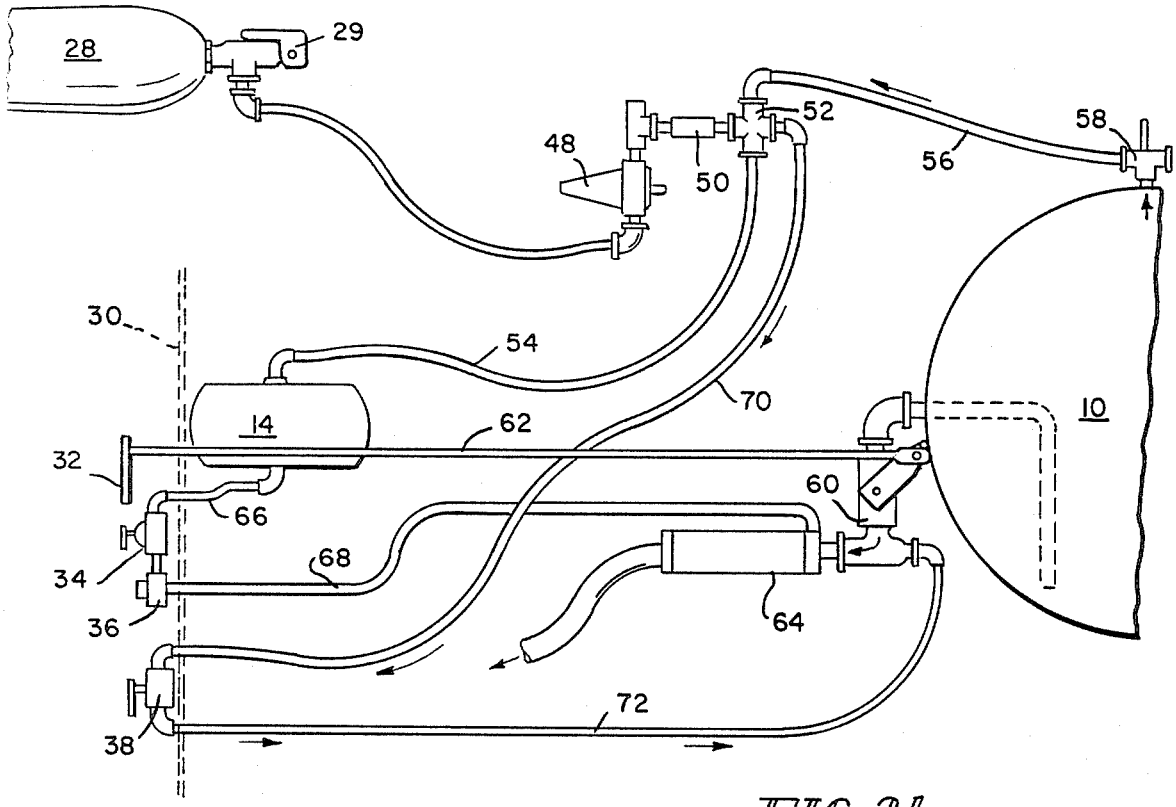

FIGS. 2(*a*) and 2(*b*) illustrate a preferred piping arrangement for an embodiment of the present invention which utilizes water and water/foam concentrate mixtures as fire extinguishing agents. The valve settings and arrows in FIG. 2(*a*) illustrate the various fluid flows taking place during the operational (i.e., discharge) mode for a water/foam concentrate mixture. In FIG. 2(*a*), compressed gas cylinder 28 is connected via regulator 48 and check valve 50 to multiport pipe fitting 52. Pipe fitting 52 is connected via pipes 54 and 56 to foam concentrate tank 14 and water tank 10, respectively. Tank 10 is provided with a pressure relief valve 58 to limit the maximum internal tank pressure. Water is discharged from tank 10 via control valve 60 which is operated by linkage 62 which extends through control panel 30 and terminates with water supply control 32 (preferably a T-handle control). In the position shown, control 32 and linkage 62 are in the "pulled out" position which allows water to flow from tank 10. Water flowing from tank 10 through control valve 60 enters the input end of foam inductor 64. The output end of inductor 64 is connected to one of the lengths of hose on hose reel 18. An outlet port of foam concentrate tank 14 is connected, via pipes 66 and 68, to foam concentrate supply valve 34 and foam proportioning valve 36 which are located on central control panel 30. Supply valve 34 enables the operator to selectively add foam concentrate to the water flowing through inductor 64. Proportioning valve 36 allows the percentage of the foam concentrate/water mixture to be adjusted to a variety of settings (typically 1, 3 and 6 percent).

If water-only operation is desired, control valve 34 is closed to block the flow of foam concentrate to inductor 64. It should be noted that water discharging from tank 10 preferably passes through inductor 64 on route to the hose and discharge nozzle, regardless of whether or not foam concentrate is being supplied to inductor 64 from tank 14 (i.e., there is no by-pass around inductor 64). For this reason, inductor 64 must be of an adequate size to handle the flow when discharging water only or water/foam concentrate mixtures. In the preferred embodiment illustrated, the flow capacity of inductor 64 is approximately 60 gallons per minute.

FIG. 2(*b*) shows the arrangement of FIG. 2, with the control valves set for and the arrows indicating the flow of fluids in a purging operation which normally follows operation in the water/foam concentrate mode. In the purging operation, water supply control 32 and foam concentrate supply valve 34 are closed and purge valve 38 is opened. Compressed gas from cylinder 28 flows from multiport fitting 52 via pipes 70 and 72 to the input end of inductor 64. The remaining foam and water are thus forced from the hose and discharge nozzle by compressed gas. As illustrated, all controls and valves necessary to perform the discharge and purging operations are accessible at central control panel 30.

Figure 3A:
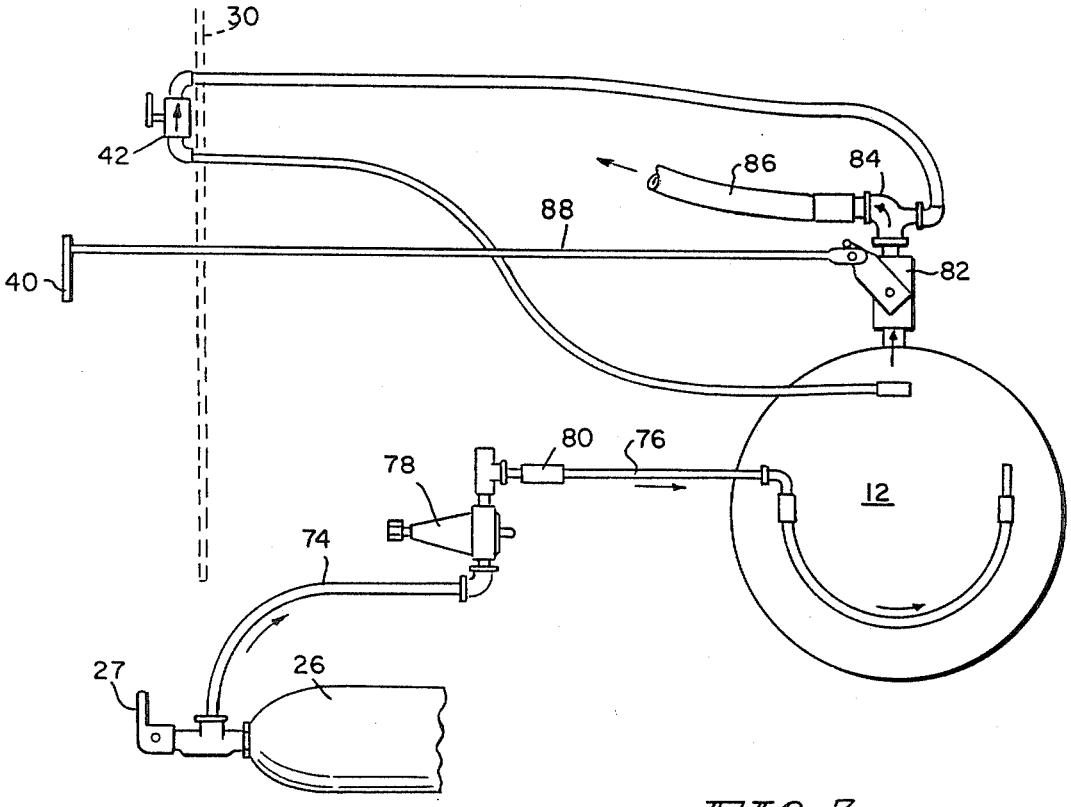
FIGS. 3(*a*) and 3(*b*) show a preferred piping arrangement for the chemical fire extinguishing agent system of a preferred embodiment of the present invention.
Figure 3B:
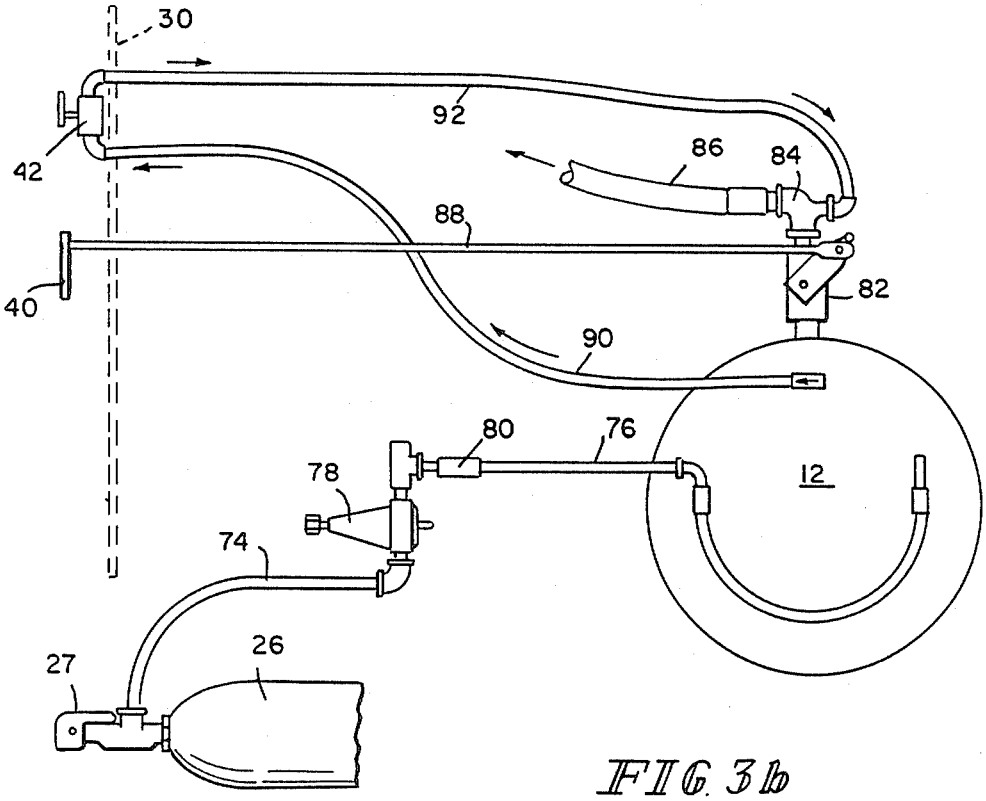

FIGS. 3(*a*) and 3(*b*) illustrate a preferred piping arrangement for use with a chemical fire extinguishing agent such as dry powder. In FIG. 3(*a*), the valve settings and the arrows indicate the flows of compressed gas and fire fighting agent in the operational (i.e., discharge) mode, while the settings and arrows in FIG. 3(*b*) indicate fluid flows during a purging operation. With reference to FIG. 3(*a*), compressed gas is supplied to chemical supply tank 12 via pipes 74 and 76, regulator 78, and check valve 80. The compressed gas creates a pressure head inside tank 12. Dry chemical supply valve 82 is connected to an outlet of tank 12 and, via fittings 84 and 86, to a hose on the hose reel. Supply valve 82 is connected to linkage 88 which extends through control panel 30 and is connected to chemical fire extinguishing agent control 40. When control 40 is in the operated (i.e., pulled out) position, supply valve 82 is open and a flow of chemical fire extinguishing agent is supplied to the hose and discharge nozzle 24.

The settings and arrows in FIG. 3(*b*) illustrate operation of the chemical fire extinguishing agent system in a purge mode. In FIG. 3(*b*), valves 27 and 82 are closed and valve 42 is open. This allows the trapped head pressure in tank 12 to flow via pipes 90 and 92 through the hose and discharge nozzle to purge the chemical agent from the system. As with the other operations, all controls for performing this operation are accessible at control panel 30 or, in the case of valve 27, immediately adjacent thereto. In addition to being a relatively simple piping arrangement, an added advantage to this purging arrangement results from the fact that pressure from cylinder 26 is not used directly in the purging operation. This prevents the loss of an excessive amount of compressed gas during the purge operation.

Figure 4A:
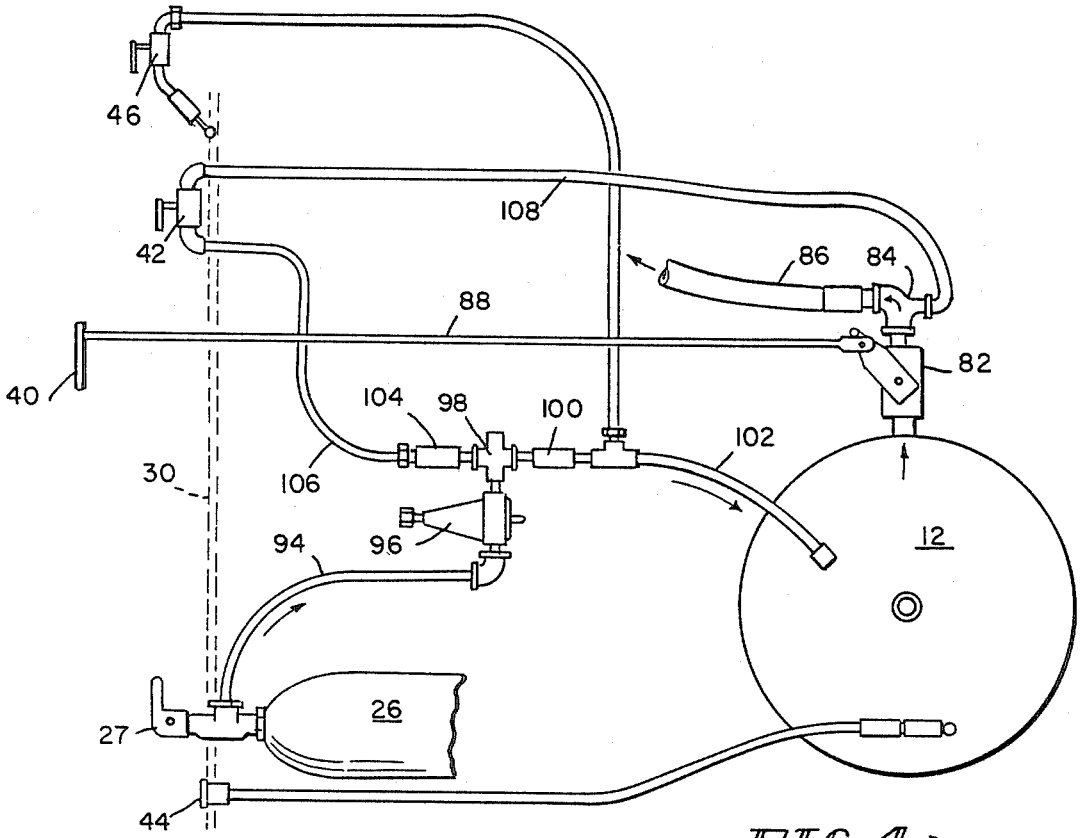
FIGS. 4(*a*), 4(*b*) and 4(*c*) show an alternative piping arrangement for the chemical fire extinguishing agent system which is especially preferred when Halon is used as the chemical fire extinguishing agent.
Figure 4B:
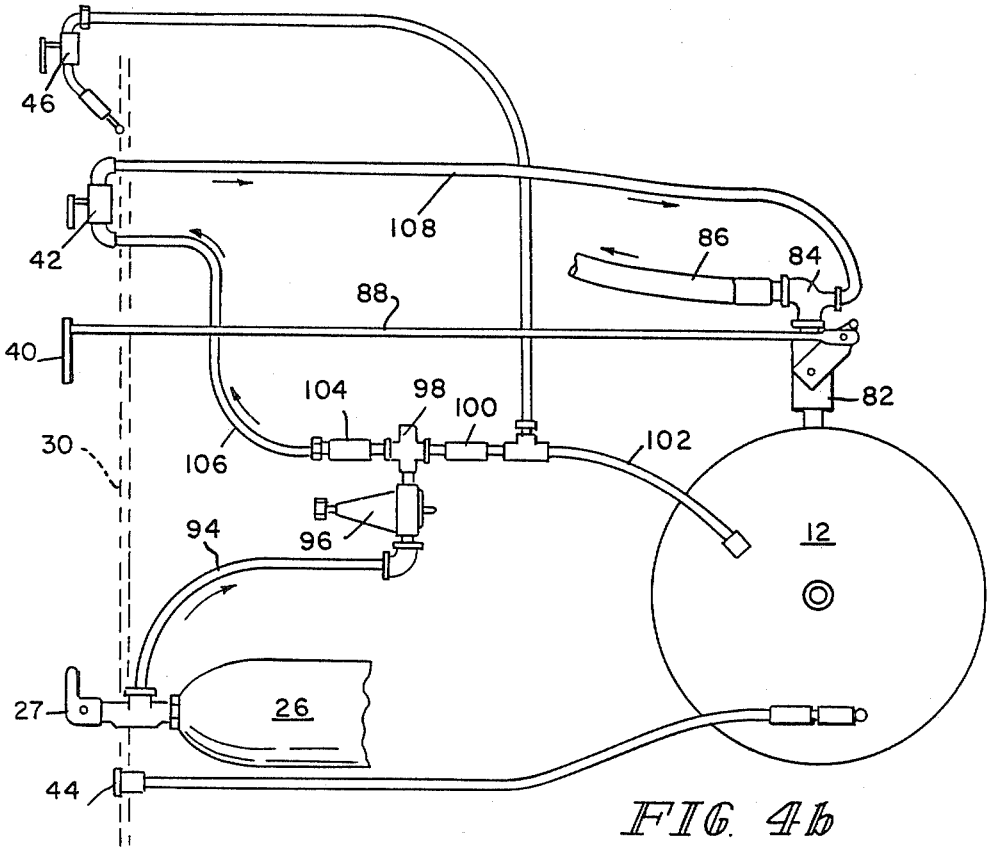
Figure 4C:
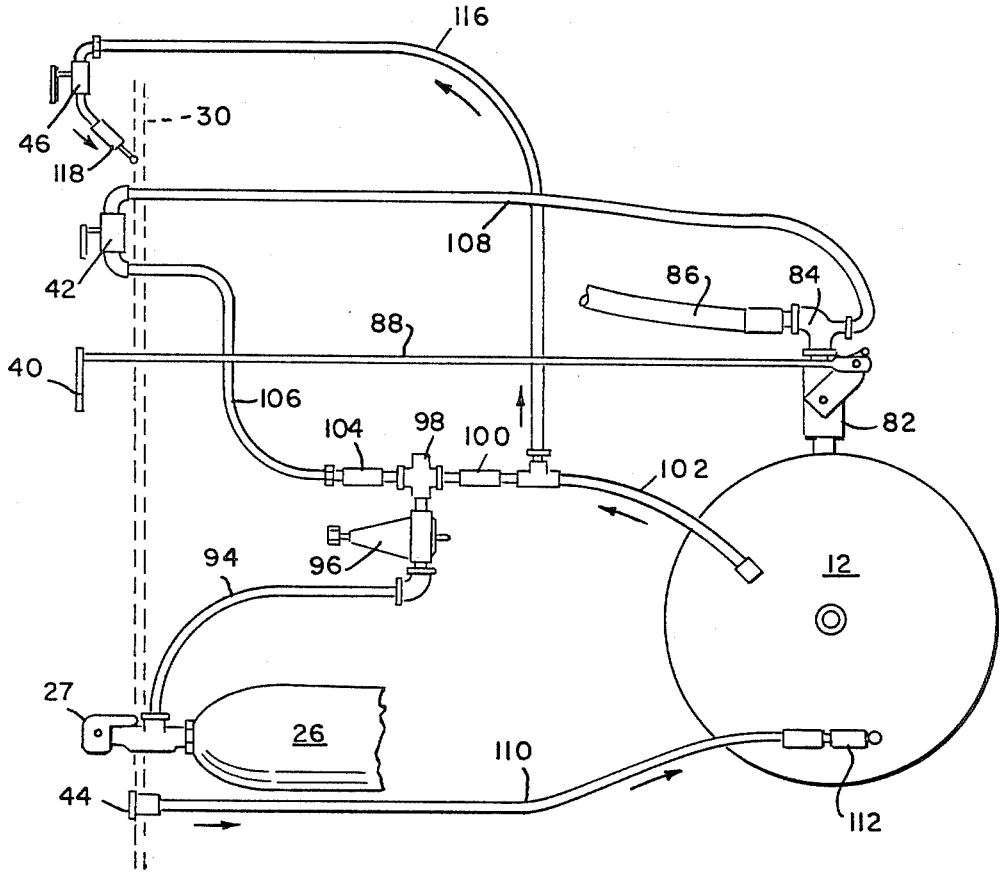

FIGS. 4(*a*), 4(*b*) and 4(*c*) show an alternative piping arrangement for use when Halon is selected as the chemical fire extinguishing agent. Halon is a normally gaseous substance which liquifies under pressure. Thus, the head pressure in tank 12 must be maintained and cannot be used in the purging operation, as described above. With reference to FIG. 4(*a*), compressed gas cylinder 26 is connected to tank 12 via pipe 94, regulator 96, fitting 98, check valve 100 and pipe 102. When supply valve 82 is open, as illustrated in FIG. 4(*a*), Halon is supplied to discharge nozzle 24.

With reference to FIG. 4(*b*), compressed gas cylinder 26 is connected to purge valve 42 via pipe 94, regulator 96, fitting 98, check valve 104 and pipe 106. The other end of valve 42 is connected to fitting 84 via pipe 108. In the purging operation, valve 27 remains open, valve 82 is closed, and valve 42 is opened to allow compressed gas from cylinder 26 to flow through the hose and discharge nozzle 24.

The control settings and arrows of FIG. 4(*c*) illustrate the operation of the Halon piping arrangement in a refill mode. In this arrangement, refill coupler 44 is provided at control panel 30 and is connected to tank 12 by pipe 110. A pressure relief valve 112 is provided at the tank to prevent overpressurization. To allow the tank to fill, vent valve 46 is opened to allow gases from tank 12 to flow out via pipe 102, fitting 114, pipe 116, valve 46 and refill vent regulator 118. As with all the previous operations described, access to all controls, valves and couplings necessary to perform this operation is provided at central control panel 30.

Providing convenient access to the various controls and components necessary to operate the fire fighting apparatus of the present invention is greatly facilitated by the extensive use of pressure rated plastic tubing in the piping arrangements previously described. This tubing is relatively compact and flexible, and is relatively inexpensive in comparison with rigid, metal pipes (such as stainless steel) which are more commonly used in such applications. This makes possible the grouping of the control elements at a centralized control panel while maintaining a relatively compact size configuration, and without undue expense. This arrangement enables the operator to perform all necessary operations from a central location, and eliminates the need for climbing onto or around the apparatus to operate the various valves. An added advantage to the use of plastic tubing in place of the more rigid steel plumbing is a marked reduction in problems associated with vibration caused by field operating conditions which commonly occur in apparatus which utilizes rigid piping.

Although the present invention has been described and illustrated in detail by reference a preferred embodiment, it is to be clearly understood that the same is by way of illustration and example only, and is not to be taken by way of limitation. The spirit and scope of the present invention are to be limited only by the terms of the appended claims.

What is claimed is:

1. A fire-fighting apparatus, comprising:

a frame having two ends and two sides;

a first tank supported on a first end of the frame and containing a quantity of water;

means for selectively connecting the first tank to a first discharge nozzle;

a second tank supported on the frame and containing a quantity of chemical fire-extinguishing agent;

means for selectively connecting the second tank to a second discharge nozzle;

a third tank supported on the frame and containing a foam concentrate;

means for selectively connecting the third tank to the first discharge nozzle and for mixing a predetermined quantity of foam concentrate with water flowing from the first tank to the first discharge nozzle;

means for pressurizing the first, second and third tanks with a compressed fluid;

a hose reel supported on a second end of the frame;

a central control panel supported on the second end of the frame adjacent the hose reel, said control panel having first and second sides respectively supported by first and second sides of the frame; and control means, mounted on the central control panel and connected to the means for connecting the first, second and third tanks to the first and second discharge nozzles, for selectively controlling the supply of water, foam concentrate and chemical fire-extinguishing agent to the first and second nozzles, respectively, and for selectively controlling the refilling of the first, second and third tanks, and for selectively controlling the purging of the means for connecting the first, second and third tanks to the first and second discharge nozzles;

wherein said control means includes a plurality of control elements mounted on the first side of the control panel for controlling the discharge, purging, metering and mixing of water and foam concentrate from the first and third tanks, and a plurality of control elements mounted on the second side of the control panel for controlling the discharge, purging, and refill of chemical fire-extinguishing agent from the second tank.

2. A fire-fighting apparatus according to claim 1, wherein the means for pressurizing the first, second and third tanks and for purging the first nozzle and its associated connecting means includes a source of compressed fluid.

3. A fire-fighting apparatus according to claim 2, wherein the control elements for controlling the purging operations are connected to the source of compressed fluid and to the respective nozzles and connecting means by non-metallic, relatively flexible piping.

4. A fire-fighting apparatus according to claim 1, wherein said means for connecting the first and third tanks to the first discharge nozzle includes a foam inductor serially connected between the first nozzle and the first and third tanks.

5. A fire-fighting apparatus according to claim 4, wherein the foam inductor has a fluid carrying capacity of approximately 60 gallons per minute.

6. A fire-fighting apparatus according to claim 1, wherein the chemical fire-extinguishing agent is Halon.

7. A fire-fighting apparatus according to claim 1, wherein the control elements for controlling refill of chemical fire-extinguishing agent are connected to the second tank by non-metallic, relatively flexible tubing.

8. A fire-fighting apparatus according to claim 1, wherein the frame is adapted to allow the apparatus to be carried by a forklift truck.

9. A fire-fighting apparatus according to claim 1, wherein the frame is adapted to allow the apparatus to be mounted on a truck.

10. A fire-fighting apparatus according to claim 1, wherein the capacity of the first tank is approximately 200 gallons, the capacity of the second tank is approximately 500 pounds, and the capacity of the third tank is approximately 15 gallons.

* * * * *